US011624177B2

(12) United States Patent
Bickerton

(10) Patent No.: US 11,624,177 B2
(45) Date of Patent: Apr. 11, 2023

(54) OUTDOOR PORTABLE LIQUID DISPENSING STATION AND RELATED KIT FOR HEATING FAUCET

(71) Applicant: 10058480 MB Ltd., Winkler (CA)

(72) Inventor: Dan Bickerton, Winkler (CA)

(73) Assignee: 10058480 MB Ltd.

( * ) Notice: Subject to any disclaimer, the term of this patent is extended or adjusted under 35 U.S.C. 154(b) by 113 days.

(21) Appl. No.: 17/225,298

(22) Filed: Apr. 8, 2021

(65) Prior Publication Data

US 2021/0395984 A1 Dec. 23, 2021

Related U.S. Application Data

(60) Provisional application No. 63/040,637, filed on Jun. 18, 2020.

(51) Int. Cl.

| | |
|---|---|
| ***E03C 1/184*** | (2006.01) |
| ***A47K 5/12*** | (2006.01) |
| ***A47K 1/02*** | (2006.01) |

(52) U.S. Cl.

CPC ..... *E03C 1/184* (2013.01); *A47K 1/02* (2013.01); *A47K 5/12* (2013.01)

(58) Field of Classification Search

CPC ..... E03C 1/184; A47K 1/02; A47K 5/12

USPC ..... 222/146.5

See application file for complete search history.

(56) References Cited

U.S. PATENT DOCUMENTS

| | | | | | |
|---|---|---|---|---|---|
| 5,465,438 | A * | 11/1995 | Allman | A47K 1/02 | 4/640 |
| 5,524,643 | A * | 6/1996 | Faries, Jr. | A61F 7/0241 | 128/849 |
| 5,530,973 | A * | 7/1996 | Dodge | A47K 1/02 | 4/654 |
| 6,161,228 | A * | 12/2000 | Wietecha | A47K 1/02 | 4/625 |
| 6,173,458 | B1 * | 1/2001 | Maddux | A47K 1/02 | 4/619 |
| 10,271,691 | B1 * | 4/2019 | Boyle | A47K 1/02 | |
| 11,064,843 | B1 * | 7/2021 | Swartz | E04H 1/1205 | |
| 2003/0019031 | A1 * | 1/2003 | Mosis | E03C 1/18 | 4/625 |
| 2005/0044625 | A1 * | 3/2005 | Kommers | G05D 23/19 | 4/654 |

(Continued)

*Primary Examiner* — Benjamin R Shaw

(74) *Attorney, Agent, or Firm* — Christopher J. Dynowski; Ryan W. Dupuis; Ade & Company Inc.

(57) ABSTRACT

A portable liquid dispensing station for outdoor use in cold temperatures comprises a housing defining a base for resting on a support surface and enclosed interior thereover, at least one liquid storage tank supported inside the housing for containing unused liquid, a pump supported inside the housing in fluidic communication with the tank for conveying the unused liquid under pressure to a downstream location, a liquid dispensing device supported externally of the housing but in downstream fluidic communication with the tank for selectively releasing the liquid, a basin supported externally of the housing for collecting the released liquid, and a collection tank in fluidic communication with the basin to collect the used liquid for storage and which is supported inside the housing. The liquid dispensing device, the basin and the collection tank are heated and the air inside the housing is also heated to prevent the liquid from freezing.

18 Claims, 7 Drawing Sheets

(56) References Cited

U.S. PATENT DOCUMENTS

| | | | | |
|---|---|---|---|---|
| 2007/0199146 | A1* | 8/2007 | Kostelyk | E03B 11/02 4/625 |
| 2014/0366262 | A1* | 12/2014 | Flynn | A47K 3/32 4/514 |
| 2021/0321829 | A1* | 10/2021 | Shell | A47K 1/02 |

* cited by examiner

OUTDOOR PORTABLE LIQUID DISPENSING STATION AND RELATED KIT FOR HEATING FAUCET

This application claims the benefit under 35 U.S.C. 119(e) of U.S. Provisional Application Ser. No. 63/040,637 filed Jun. 18, 2020.

FIELD OF THE INVENTION

The present invention relates generally to an outdoor portable liquid dispensing station, and more particularly to such a station which is suited for use in cold temperatures.

BACKGROUND

Portable liquid dispensing stations are known as evidenced for example by U.S. Pat. No. 6,173,458 by Maddux which shows a sink having a sink module and a hot and cold water outlet connected to a spigot and a used water outlet from said sink connected to a cabinet mounted on wheels having at least one door to access the interior thereof. At least one tank for fresh water and a reservoir for used water is mounted in the cabinet. An electrical connection for powering a pump and a heater connected to the outlet of the pump has an outlet connected to the hot water outlet and a connection from the pump to the cold water outlet.

Another example is U.S. Patent Application Publication 2010/0078904 by Collins which shows a mobile medical cart with a mobile medical wash station that provides a wash sink/faucet and counter top structure that allows health care provides to carry out their services in a hygienic manner. The unit provides as close to an in hospital wash station as possible on a mobile platform and includes external connections to an electrical power source and a pressurized water supply.

None of the foregoing examples are suited for outdoor use in cold temperatures, however.

SUMMARY OF THE INVENTION

According to an aspect of the invention there is provided a portable liquid dispensing station for outdoor use in cold temperatures comprising:

a housing defining a base arranged for resting on a support surface and a substantially enclosed interior over the base;

an unused liquid storage tank supported in the interior of the housing for containing unused liquid to be dispensed;

a heated liquid tank supported in the interior of the housing and disposed in fluidic communication with the unused liquid storage tank for receiving the unused liquid therefrom, the heated liquid tank being configured for heating and containing the unused liquid for subsequent dispensing;

a pump supported in the interior of the housing and disposed in operative fluidic communication with the unused liquid storage tank and the heated liquid tank to convey the unused liquid therefrom under pressure to a location which is downstream relative to a flow of the unused liquid;

a liquid dispensing device supported externally of the housing and disposed in fluidic communication with the unused liquid storage tank and the heated liquid tank downstream of the pump for receiving the unused liquid under pressure, the liquid dispensing device being configured for selectively releasing the liquid externally of the housing;

a basin supported externally of the housing and arranged for collecting the liquid released from the liquid dispensing device;

a waste liquid collection tank disposed in fluidic communication with the basin and supported in the interior of the housing for receiving and containing used liquid for subsequent removal from the housing; and a heating assembly comprising:

an air heater supported in the interior of the housing and arranged for heating air contained in the interior of the housing to heat the unused liquid storage tank and the heated liquid tank;

a waste liquid collection tank heater arranged for applying heat to the waste liquid collection tank to in turn heat the liquid contained therein; and a basin heater arranged for applying heat to the basin to in turn heat the liquid contained therein.

This provides an arrangement which can operate in cold temperatures to continually dispense stored liquid that is susceptible to freezing in the cold temperatures.

Preferably, the heating assembly further includes a liquid dispensing device heater arranged for applying heat to the liquid dispensing device to in turn heat the liquid passing therethrough.

In one such arrangement, the liquid dispensing device comprises a thermally conductive faucet defining a discharge end disposed externally of the housing and arranged for releasing the liquid into the basin and a supply end disposed in the interior of the housing and arranged for fluidic coupling to a liquid supply line arranged to convey the liquid thereto, and wherein the liquid dispensing device heater comprises (i) a thermally conductive body disposed in the interior of the housing and attached to the faucet at or adjacent the supply end to provide an interface for heat transmission, and (ii) a radiant heat source configured for applying heat to the thermally conductive body to be transmitted thereby to the faucet via said interface for heat transmission.

Preferably, when the faucet includes a flange coupled thereto externally of the housing and disposed in spaced relation to the thermally conductive body, the thermally conductive body is threadably mated on an externally threaded connection portion of the faucet defining the supply end, so as to act as a fastener for cooperating with the flange to mount the faucet by clamping action to an intermediary wall between the thermally conductive body and the flange.

In one arrangement the thermally conductive body comprises:

a nut portion defining a threaded bore with a diameter substantially equal to an outer diameter of the threaded connection portion of the faucet so as to be configured for threadable mating thereon to clampingly engage the intermediary wall and to provide the interface for heat transmission, wherein the nut portion is shorter in length than the connection portion of the faucet such that the connection portion projects beyond the nut portion to present the supply end in spaced relation to the nut portion for receiving the liquid supply line; and an extension portion removably attached to the nut portion and defining a bore with a diameter greater than the bore of the nut portion to permit passage therethrough of the liquid supply line fluidicallly coupled to the supply end of the faucet, wherein the extension portion is sized longer in length than the nut portion so as to increase a surface area of the thermally conductive body for receiving heat from the radiant heat source.

In the illustrated arrangement the radiant heat source is in the form of an electric wire wrapped around the thermally conductive body and configured to generate heat upon passage of electric current along the electric wire.

Typically the basin and the waste liquid collection tank are fluidically intercommunicated by a drain conduit. In such an arrangement, preferably the heating assembly further includes a drain conduit heater for applying heat to the drain conduit.

In the illustrated arrangement, the drain conduit heater is in the form of an electric wire wrapped around the drain conduit and configured to generate heat upon passage of electric current along the electric wire.

Preferably, the air heater is operatively associated with a thermostat configured to actuate the air heater and supported externally of the housing so as to be exposed to an ambient environment. This allows the thermostat to activate the air heater for heating the air inside the housing to a temperature responsive to a temperature of the ambient environment.

Preferably the station further includes a soap dispenser configured to contain and selectively release soap and carried by the housing at an exterior accessible location thereon.

Preferably, in such an arrangement, the housing forms an enclosed compartment distinct from the interior of the housing and arranged for receiving the soap dispenser, the enclosed compartment comprising a plurality of openings by which the enclosed compartment is in communication with the interior of the housing to receive heated air therefrom so as to act to heat the soap dispenser.

In the illustrated arrangement, the enclosed compartment is formed by a receptacle recessed into an exterior wall of the housing and an openable door which is carried for movement relative to the receptacle between a closed position in which the compartment is enclosed to maintain the heated air around the soap dispenser and an open position in which the compartment is open for accessing the soap dispenser.

In the illustrated arrangement the basin is made from stainless steel. This material is suitably thermally conductive to spread heat from areas of the basin which are directly heated to areas where heat is not directly applied.

In the illustrated arrangement, the basin heater is in the form of an electric wire configured to generate heat upon passage of electric current along the electric wire, wherein the electric wire traverses a path across a surface of the basin disposed in the interior of the housing.

In the illustrated arrangement, the waste liquid collection tank heater is in the form of an electric wire configured to generate heat upon passage of electric current along the electric wire, wherein the electric wire traverses a path across a surface of the waste liquid collection tank external thereto and is received in an underlying thermally insulating panel supporting the waste liquid collection tank above the base of the housing.

In the illustrated arrangement, the air heater is a convection heater.

Optionally the base comprises a plurality of forklift pockets for mating support on a forklift for transport.

Optionally the portable liquid dispensing station further includes a plurality of connection elements supported on a top of an exterior of the housing and defining openings for receiving hooks of a crane for transport.

According to another aspect of the invention there is provided a kit for heating a faucet mounted on an exterior body and configured for selectively dispensing liquid, wherein the faucet comprises an exterior discharge end arranged to release the liquid and an interior supply end arranged for fluidic coupling with a liquid supply line in an interior separated from an ambient environment by the exterior body, the kit comprising:

a thermally conductive body arranged to be disposed in the interior and attached to the faucet at or adjacent the supply end to provide an interface for heat transmission; and a radiant heat source configured for applying heat to the thermally conductive body to be transmitted thereby to the faucet via said interface for heat transmission.

According to yet another aspect of the invention there is provided a portable liquid dispensing station for outdoor use in cold temperatures comprising:

a housing defining a base arranged for resting on a support surface and a substantially enclosed interior over the base;

an unused liquid storage tank supported in the interior of the housing for containing unused liquid to be dispensed;

a heated liquid tank supported in the interior of the housing and disposed in fluidic communication with the unused liquid storage tank for receiving the unused liquid therefrom, the heated liquid tank being configured for heating and containing the unused liquid for subsequent dispensing;

a pump supported in the interior of the housing and disposed in operative fluidic communication with the unused liquid storage tank and the heated liquid tank to convey the unused liquid therefrom under pressure to a location which is downstream relative to a flow of the unused liquid;

a liquid dispensing device supported externally of the housing and disposed in fluidic communication with the unused liquid storage tank and the heated liquid tank downstream of the pump for receiving the unused liquid under pressure, the liquid dispensing device being configured for selectively releasing the liquid externally of the housing;

a basin supported externally of the housing and arranged for collecting the liquid released from the liquid dispensing device;

a waste liquid collection tank disposed in fluidic communication with the basin and supported in the interior of the housing for receiving and containing used liquid for subsequent removal from the housing;

a heating assembly comprising:

an air heater supported in the interior of the housing and arranged for heating air contained in the interior of the housing to heat the unused liquid storage tank and the heated liquid tank;

a waste liquid collection tank heater arranged for applying heat to the waste liquid collection tank to in turn heat the liquid contained therein;

a soap dispenser configured to contain and selectively release soap and carried by the housing at an exterior accessible location thereon; and wherein the housing forms an enclosed compartment distinct from the interior of the housing for receiving the soap dispenser, the enclosed compartment comprising a plurality of openings by which the enclosed compartment is in communication with the interior of the housing to receive heated air therefrom so as to act to heat the soap dispenser.

According to yet another aspect of the invention there is provided a portable liquid dispensing station for outdoor use in cold temperatures comprising:

a housing defining a base arranged for resting on a support surface and a substantially enclosed interior over the base;

a liquid storage tank supported in the interior of the housing for containing unused liquid to be dispensed;

a heating device configured for heating the unused liquid for subsequent dispensing;

a pump supported in the interior of the housing and disposed in operative fluidic communication with the liquid storage tank to convey the unused liquid therefrom under pressure to a location which is downstream relative to a flow of the unused liquid;

a liquid dispensing device supported externally of the housing and disposed in fluidic communication with the liquid storage tank downstream of the pump for receiving the unused liquid under pressure, the liquid dispensing device being configured for selectively releasing the liquid externally of the housing;

a basin supported externally of the housing and arranged for collecting the liquid released from the liquid dispensing device;

a waste liquid collection tank disposed in fluidic communication with the basin and supported in the interior of the housing for receiving and containing used liquid for subsequent removal from the housing; and a heating assembly comprising:

an air heater supported in the interior of the housing and arranged for heating air contained in the interior of the housing to heat the unused liquid storage tank and the heated liquid tank;

a waste liquid collection tank heater arranged for applying heat to the waste liquid collection tank to in turn heat the liquid contained therein; and a basin heater arranged for applying heat to the basin to in turn heat the liquid contained therein.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
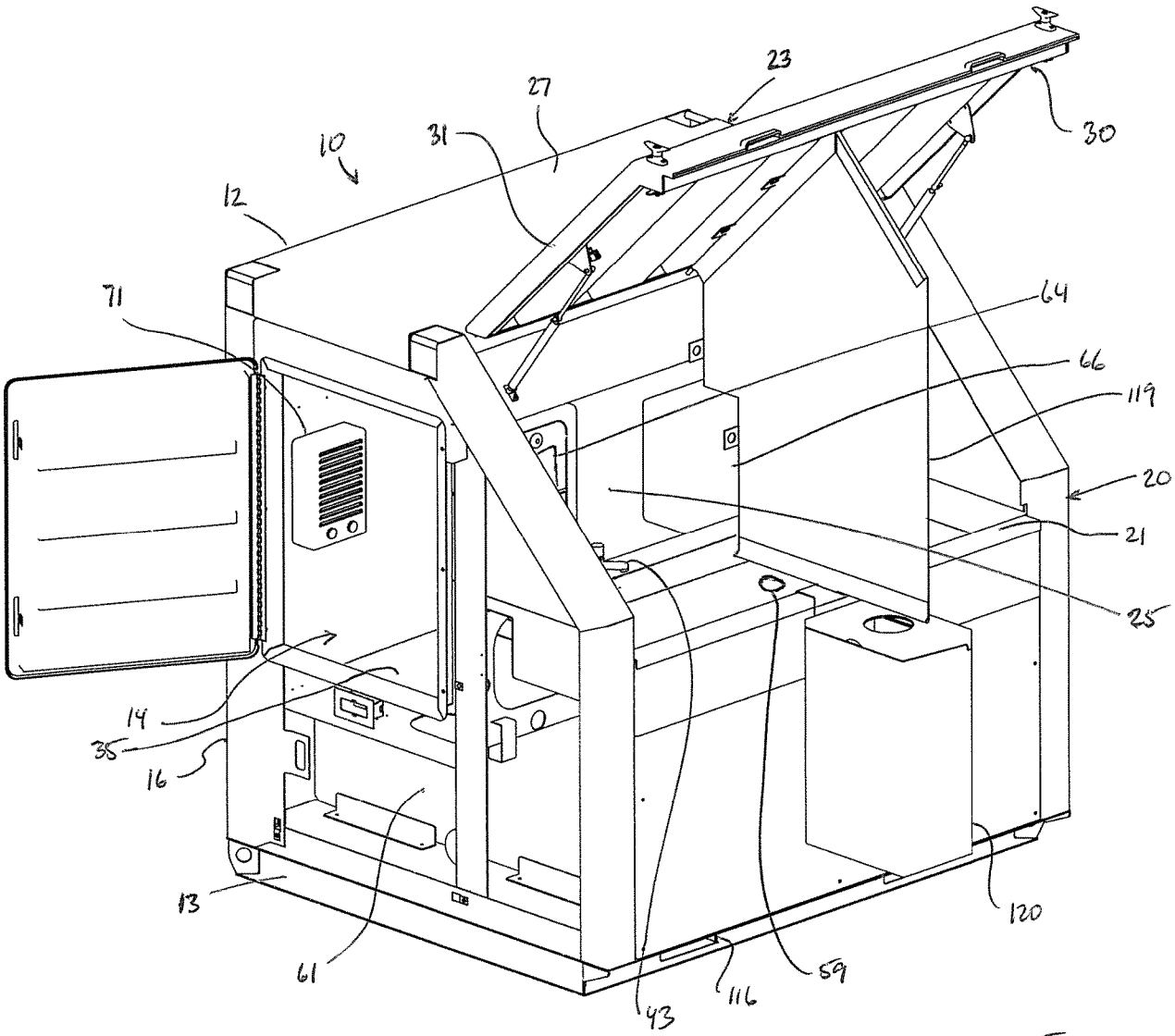
FIG. 1 is a perspective view of an arrangement of portable liquid dispensing station according to the present invention, where some components are cutaway or omitted to show an interior of the arrangement.
Figure 2:
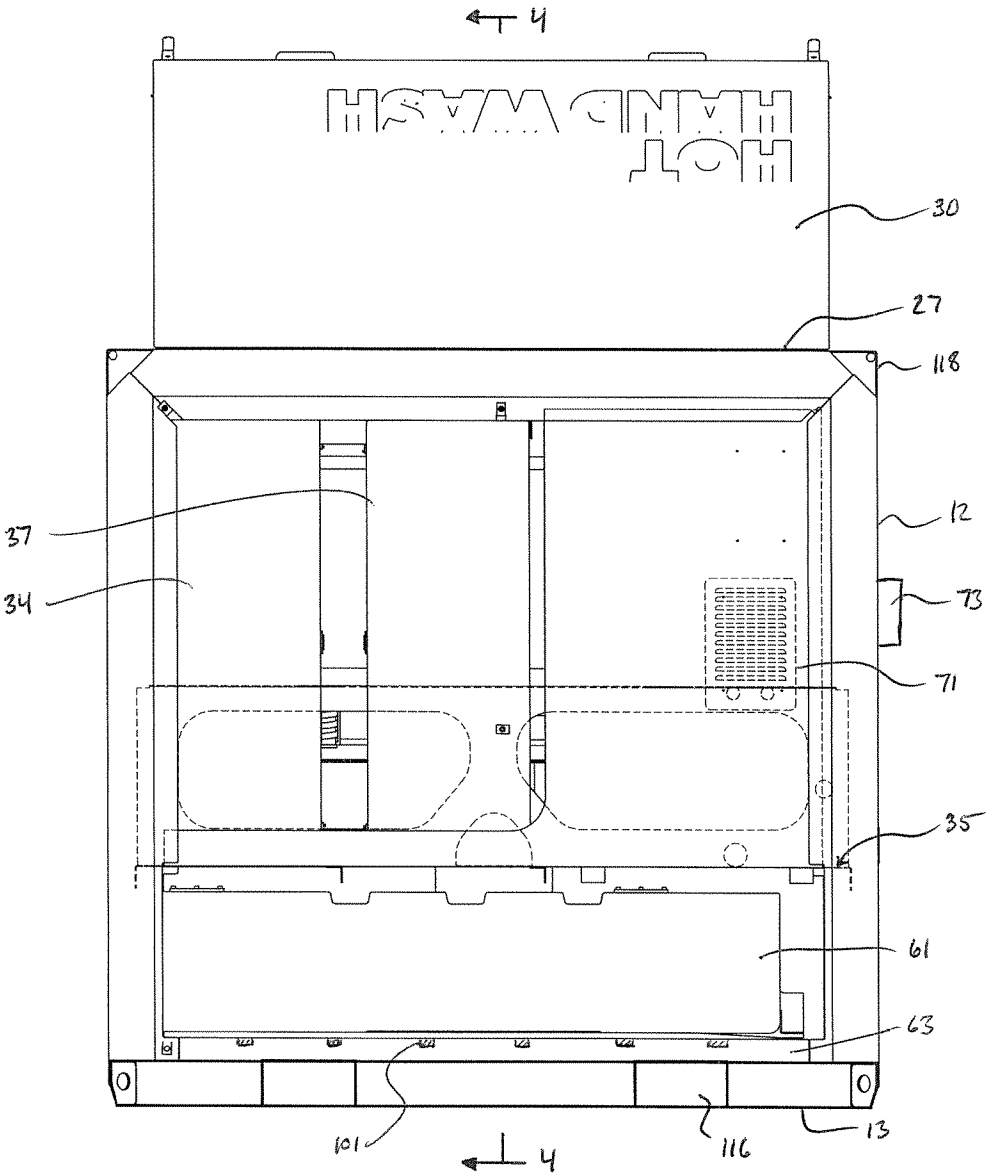
FIG. 2 is a rear view of the arrangement of FIG. 1 with some components removed or omitted to show the interior.

The accompanying figures show a portable self-contained liquid dispensing station indicated at reference numeral 10 for dispensing a liquid such as water. The station 10 is particularly suited for outdoor use in cold temperatures where the liquid being dispensed is susceptible to freezing, but it will be appreciated that it can be used indoors and/or in relatively warm temperatures under which the liquid will not freeze.

The portable liquid dispensing station 10 comprises a housing 12 which defines a base of the station 13 arranged for resting on a support surface such as a ground surface and a substantially enclosed interior 14 over the base 13 in which select components for facilitating dispensing of the liquid are contained.

The housing 12 is formed by a framework of metallic structural members such as 16 defining a periphery of the housing, and spaces delimited by the framework are closed by thermally insulating wall panels such as 18 to bridge the spaces and consequently to define the enclosed interior 14. The housing 12 has a lowered height portion 20 at a front 12A of the housing which is suited for receiving a basin 21 to close the lowered height portion at a top thereof in lieu of a thermally insulating panel. In the illustrated arrangement, the basin 21 which will be described in further detail later is supported by the housing 12 at a suitable height for hand washing.

Rearwardly of the lowered height portion 20 is a full height portion 23 of the housing which is suited for receiving relatively narrow but tall internal components of the station 10, which will be described in further detail shortly. The lowered height portion 20 and the full height portion 23 are interconnected by a wall 25 which spans only a partial height of the full height portion 23 to bridge a space between a top 27 of the housing defined by the full height portion 23 and the basin 21 in order to provide the enclosed interior 14.

The housing 12 also includes an enclosure door 30 which is movable relative to the framework 16 and to the basin 21, which is supported in fixed relation to the housing, between a closed position in which sides 31 of the enclosure door are contiguous with the framework 16 which provides walls alongside and extending above the basin in order to cover the basin 21 and render it inaccessible for use, and an open position as shown for example in FIG. 1 in which the sides 31 of the door 30 extend upwardly and generally outwardly from the framework 16, such that the basin 21 is accessible.

In the housing interior 14 there is provided an unused liquid storage tank 34, which may be referred to in industry as a fresh water tank when the liquid to be dispensed is water, which is supported in the interior 14 for containing unused liquid to be dispensed. The unused liquid storage tank 34 is carried on a generally horizontally oriented interior support wall 35 disposed within the housing 12 at a spaced height above the base 13. The unused liquid storage tank 34 has an inlet (not shown) exposed at the exterior of the housing 12 and passing through one of the panels thereof for receiving the liquid for storage in the unused liquid storage tank before being dispensed. The unused liquid storage tank 34 also includes an overfill drain (not shown) communicated with the exterior of the housing 12 to release liquid supplied at the inlet of the unused liquid storage tank 34 which cannot be received in the tank when it is full. Typically, the liquid stored in the unused liquid storage tank 34 is generally at the temperature of the air contained in the interior 14 of the housing as the tank 34 lacks a an associated heating device for heating the liquid contained therein.

In order to heat the unused liquid which is received in the station 10 for subsequent dispensing to the user, the station 10 includes an unused liquid heater in the form of a heated liquid tank 37 distinct from the storage tank 34, which is supported in the interior 14 of the housing and disposed in fluidic communication the unused liquid storage tank 34 for receiving the unused liquid therefrom. The heated liquid tank 37 is configured for heating and containing the unused liquid for subsequent dispensing. As such, the heated liquid tank 37 includes a tank body and a heating device which is arranged to generate heat and which is carried within the tank body so as to be exposed to the liquid containable therein for applying the generated heat thereto. In the illustrated arrangement, the heated liquid tank 37 is supported on the horizontal support wall 35 alongside the unused liquid storage tank 34, both of which are contained within the full height portion 23 of the housing 12.

It will be appreciated that, in some arrangements, the unused liquid storage tank 34 includes a heating device configured for heating the unused liquid stored in the tank, so as to be of a similar configuration as the heated liquid tank 37, such that there are provided a plurality of liquid containers which can heat the liquid prior to dispensing so as to increase an amount of heated unused liquid which is storable in the station. When both an unheated tank and a heated tank are provided in the station, the liquid dispensed to the user can have a temperature within a broader temperature range as the unused liquid in each tank is mixed to the user-desired temperature.

Figure 3:
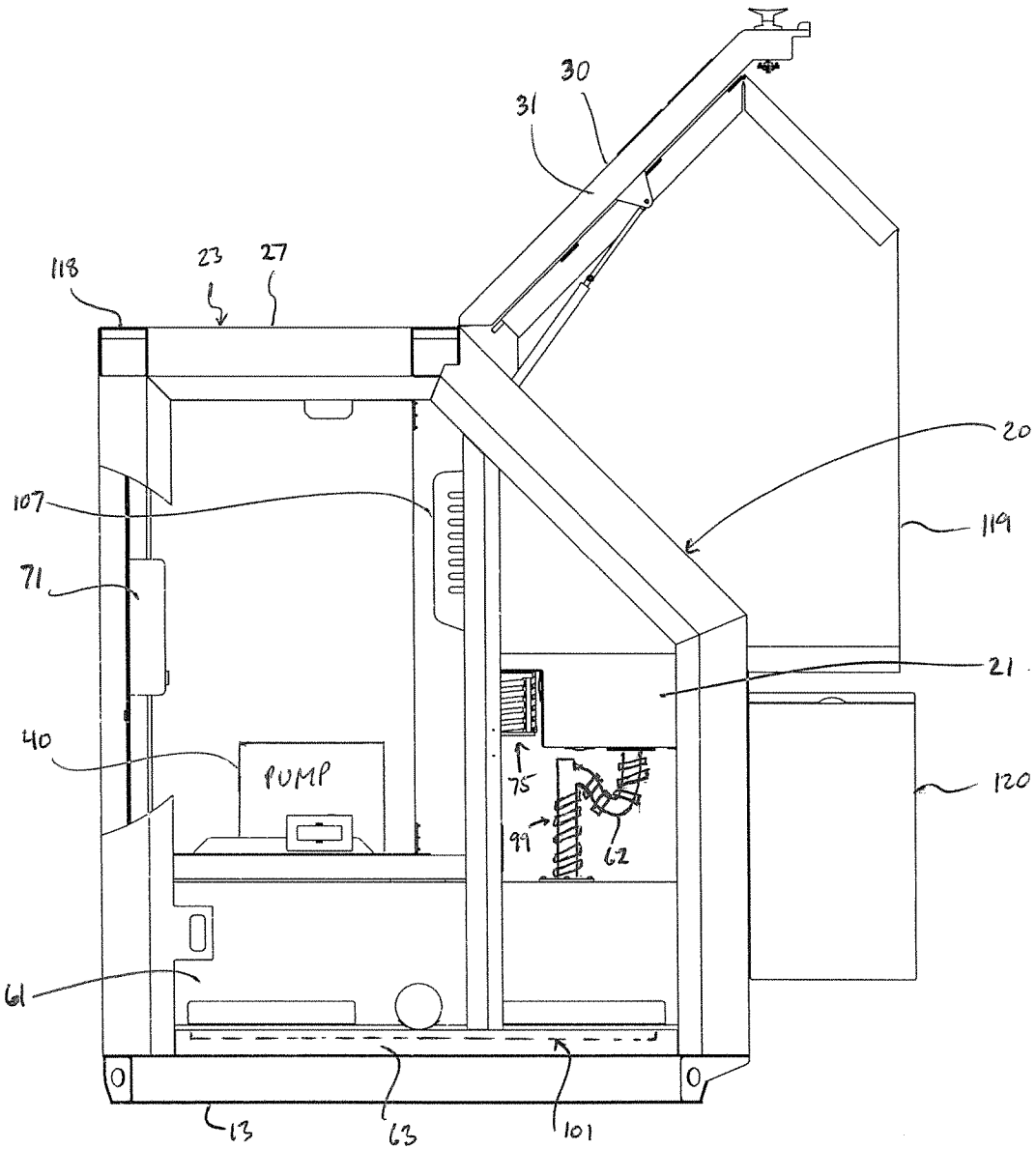
FIG. 3 is a side view of the arrangement of FIG. 1 with some components removed or omitted to show the interior.

Referring to FIG. 3, the station 10 further includes a pump 40 (schematically shown) supported in the interior 14 of the housing and disposed in operative fluidic communication with the unused liquid storage tank 34 and the heated liquid tank 37 to convey the unused liquid therefrom under pressure to a location which is downstream relative to a flow of the unused liquid.

Figure 4:
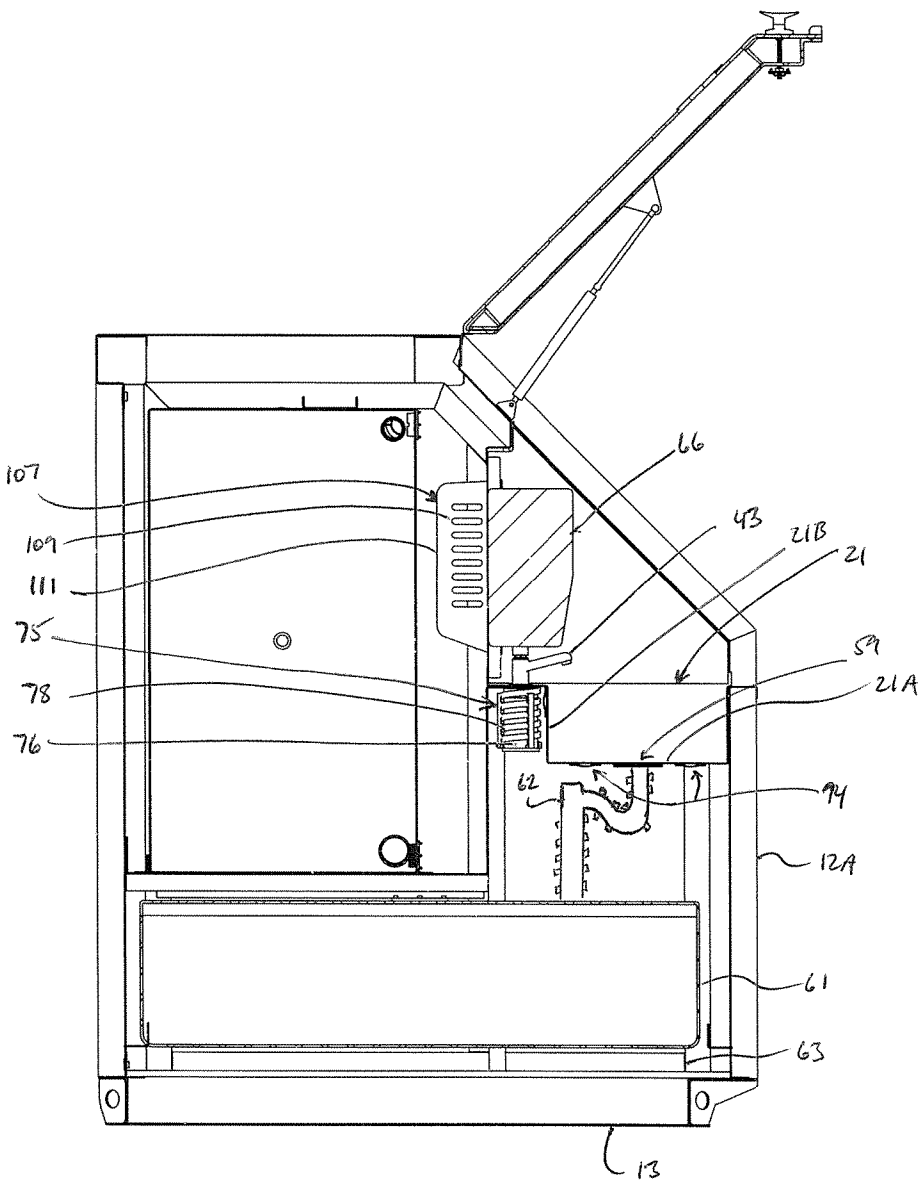
FIG. 4 is a cross-sectional view along line 4-4 in FIG. 2.
Figure 5:
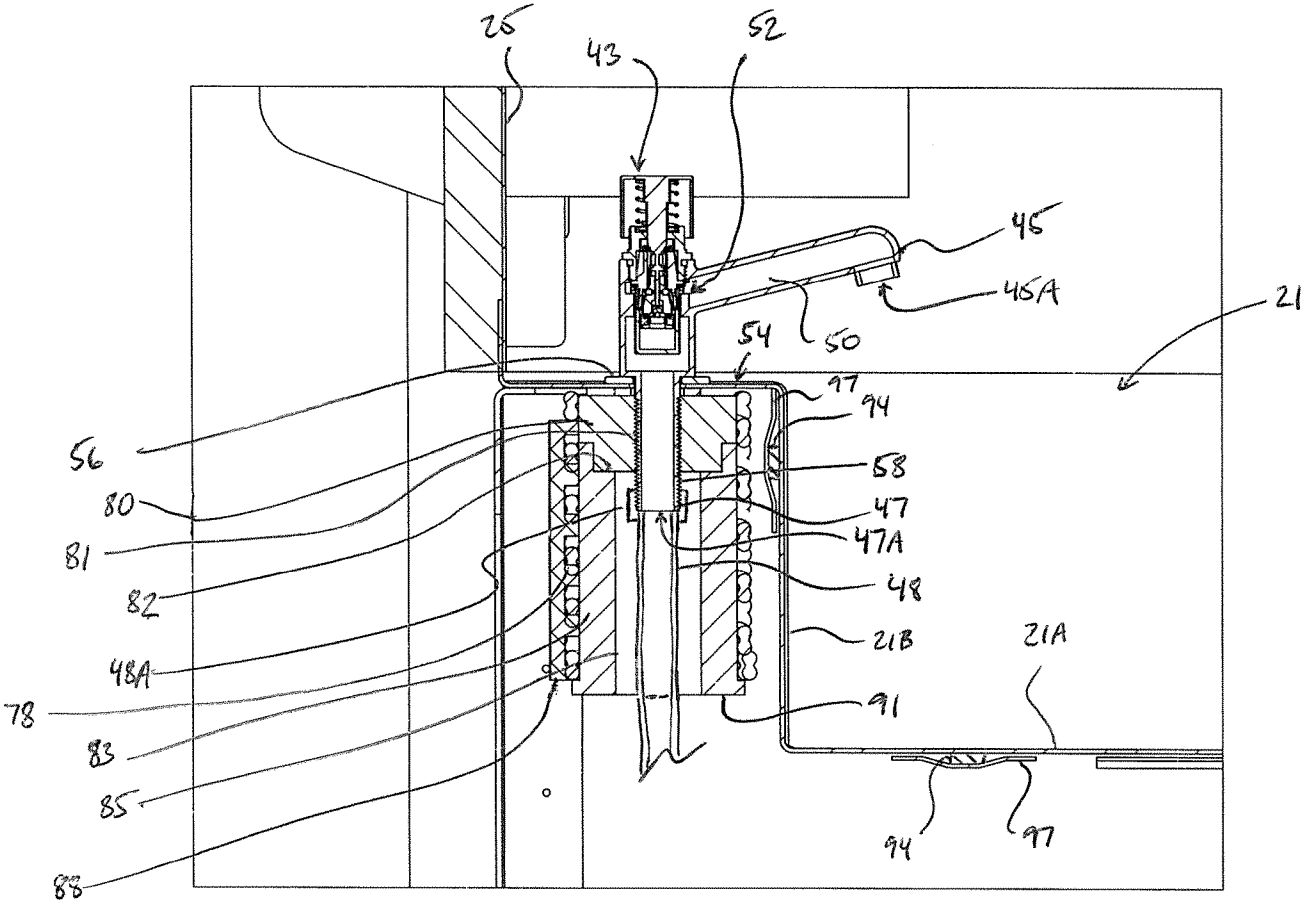
FIG. 5 is an enlarged sectional view of a liquid dispensing device and associated heater of the arrangement of FIG. 1.
Figure 6:
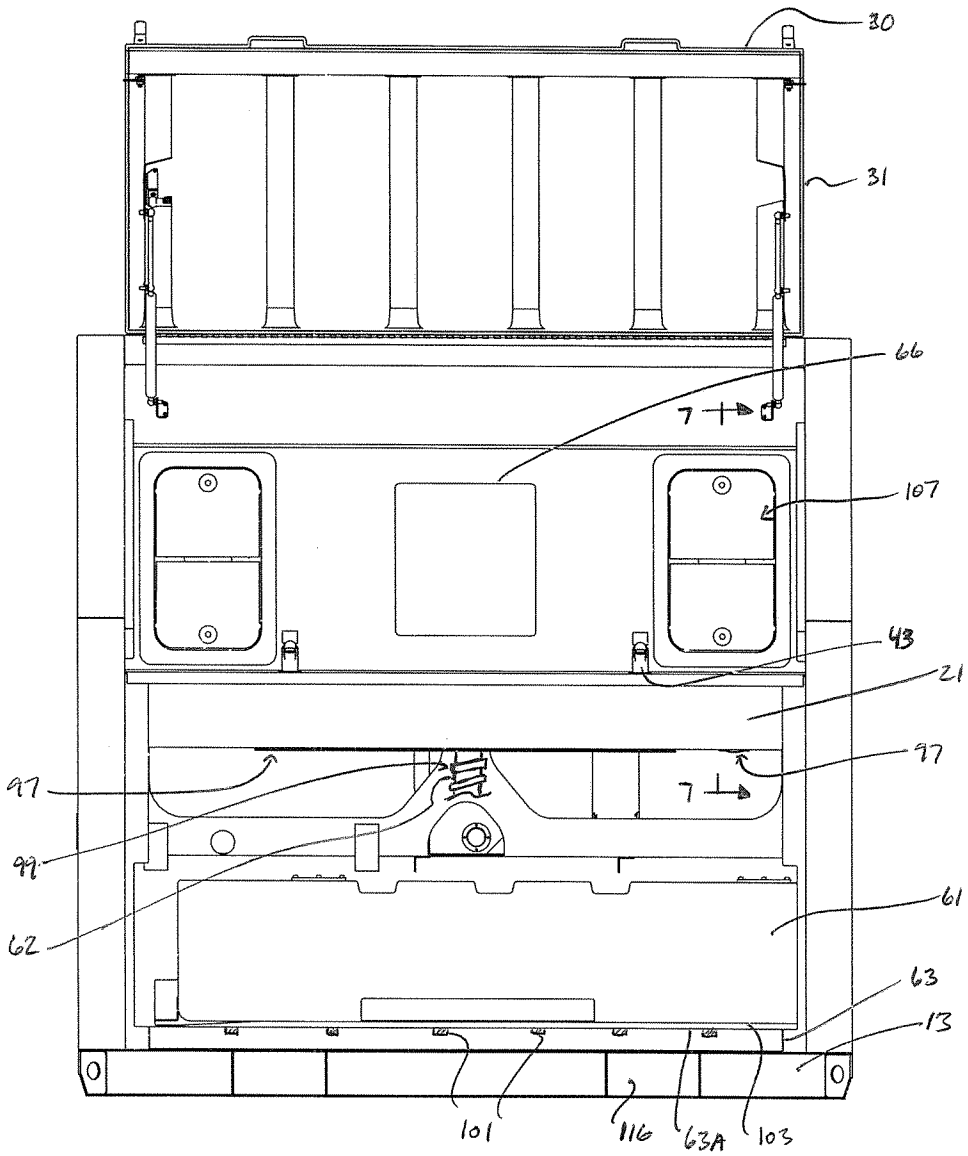
FIG. 6 is a front view of the arrangement of FIG. 1 with some components removed or omitted to show the interior.
Figure 7:
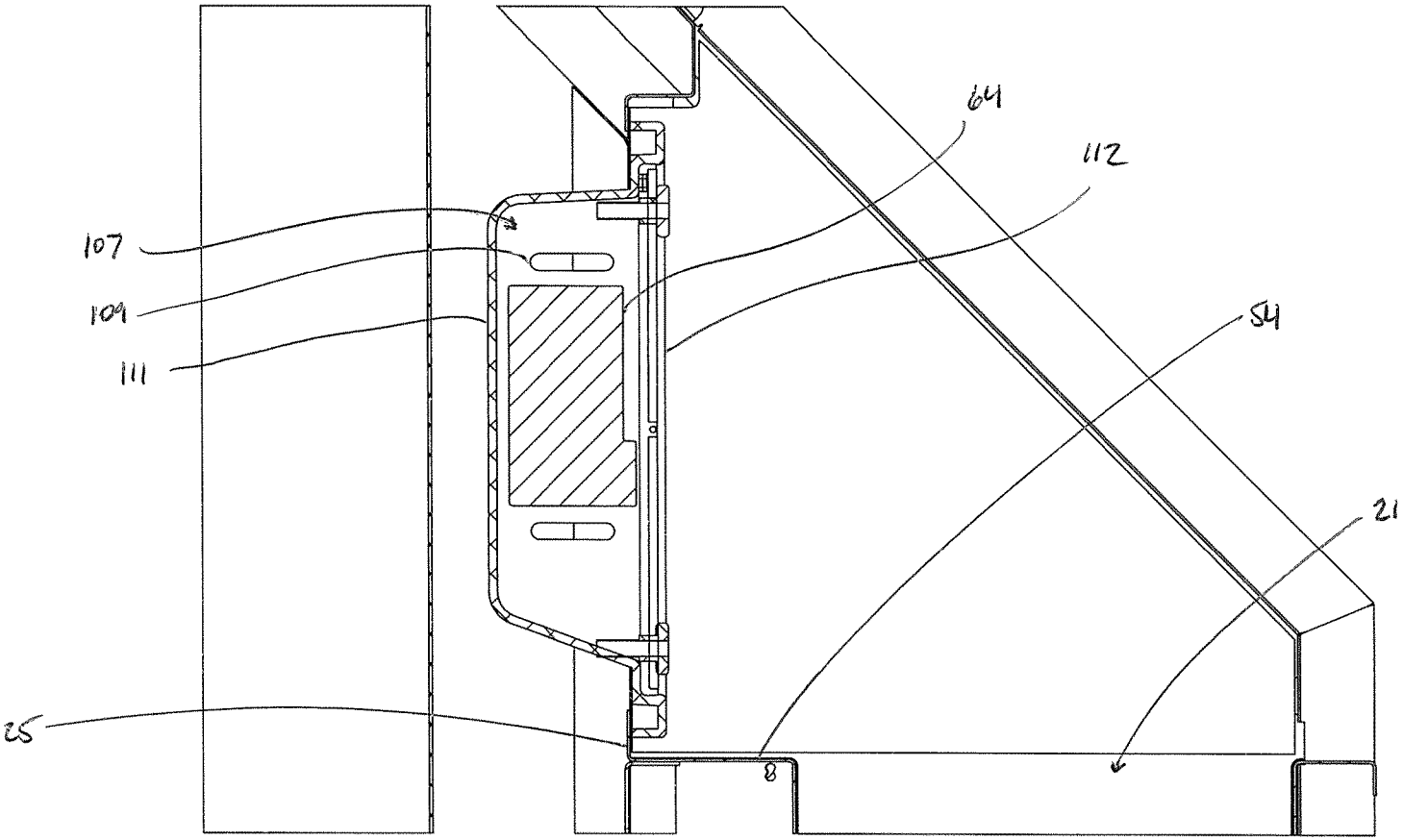
FIG. 7 is a partial cross-sectional view along line 7-7 in FIG. 6.

Referring to FIGS. 4 and 5, for releasing the unused liquid to a user, so as to be dispensed, the station 10 includes a liquid dispensing device 43 supported externally of the housing 12 at the lowered height portion 20 thereof and disposed in fluidic communication with the unused liquid storage tank 34 and the heated liquid tank 37 downstream of the pump 40 for receiving the unused liquid under pressure. The liquid dispensing device 43 is configured for selectively releasing the liquid externally of the housing 12 in response to user-activation of the device 43. As such the liquid dispensing device 43 comprises a faucet defining a discharge end 45 disposed externally of the housing 12 and arranged for releasing the liquid; a supply end 47 disposed in the interior 14 of the housing and arranged for fluidic coupling to a liquid supply line 48 arranged to convey the liquid thereto from the tanks 34, 37 that are upstream; an internal passageway 50 fluidically intercommunicating an opening 47A of the supply end 47 and an opening 45A of the discharge end 45; and a valve 52 disposed along the passageway 50 intermediate the supply and discharge ends 47, 45 and configured to control a flow of the liquid through the passageway 50. The valve 52 thus defines an intake portion of the passageway 50 which is upstream from the valve and includes the supply end 47, and a downstream outlet portion including the discharge end 45.

It will be appreciated that in the illustrated arrangement, there are provided a plurality of liquid dispensing devices 43 arranged in spaced relation to one another for dispensing into a common basin 21. Thus the multiple liquid dispensing devices 43 are in parallel fluidic communication with the unused liquid storage tank 34 and the heated liquid tank 37.

For mounting to an intermediary wall 54 delimiting the interior 14 of the housing 12 between the wall 25 and the basin 21, which in the illustrated arrangement is formed by a horizontally extending rear panel of the basin 21, the liquid dispensing device 43 comprises a flange 56, which in the illustrated arrangement is defined by a washer distinct from the faucet received beneath an enlarged central portion of the faucet where the valve 52 is carried, and which provides a lower abutment surface, and a generally cylindrical externally threaded connection portion 58 of the faucet which is arranged to be disposed in the housing interior 14 and which defines the supply end 47. The connection portion 58 is suited for threadably receiving thereon an internally threaded nut to define an upper abutment surface in opposite relation to the lower surface of the flange 56 so as to cooperate to mount the faucet in fixed relation to the housing 12 by clamping action to the intermediary wall 54.

The liquid released externally of the housing 12 by the liquid dispensing device 43 is collected by the basin 21 which is supported externally of the housing 12 at the lowered front portion 20 and is arranged for collecting the liquid released from the liquid dispensing device 43 by being arranged under the discharge end 45 of the liquid dispensing device 43. The basin 21 comprises a drain 59 located at a lowest point in the basin to permit the liquid to gravitationally exit the basin.

The liquid which is collected by the basin 21, and is thus considered used once it has been discharged from the liquid dispensing device 43, flows from the basin drain 59 to a waste liquid collection tank 61 which is disposed in fluidic communication with the basin 21 by drain conduit 62 (schematically shown) and is supported in the housing interior 14 below the basin 21 for receiving and containing used liquid for subsequent removal from the housing 12. In the illustrated arrangement, the waste liquid collection tank 61 is sized and shaped to span substantially the whole of the base 13 of the housing and is disposed below the horizontal interior support wall 35. Below the waste liquid collection tank 61 the housing includes an underlying thermally insulating panel 63 supporting the waste liquid collection tank thereon, above the base 13.

Yet further, the portable liquid dispensing station 10 of the illustrated arrangement which is particularly suited for hand washing also includes a conventional soap dispenser 64 configured to contain and selectively release soap which is a generally more viscous liquid arranged for mixing with water to remove unwanted contaminants from a surface such as a user's skin. The soap dispenser 64 is carried by the housing 12 at an exterior accessible location thereon, which in the illustrated arrangement is the partial wall 25 behind the basin 21 and extending above same.

Furthermore, the station 10 of the illustrated arrangement includes a towel dispensing device 66 configured for releasing individual towels to a user for drying hands after washing, which is supported externally on the wall 25 of the housing 12.

To prevent the liquid which is stored and dispensed by the station 10 from freezing, there is provided a heating assembly formed by a number of distinct heating devices arranged to maintain the liquid in a physical liquid state as the liquid is dispensed from the storage tanks namely 34 and 37 and subsequently stored in the collection tank 61.

The heating assembly includes an air heater 71 supported in the interior 14 of the housing and arranged for heating air contained in the housing interior which acts to heat the unused liquid storage tank 34 and the heated liquid tank 37. In the illustrated arrangement, the air heater 71 is of the convection heater type and is operatively associated with a thermostat 73 (schematically shown) configured to actuate the air heater, that is to activate the air heater to operate to heat and emit heated air for circulation within the housing interior 14. The thermostat 73 is supported externally of the housing 12 so as to be exposed to an ambient environment of the portable liquid dispensing station 10, but it is in operative communication to control the air heater 71 disposed inside the housing 12. This allows the thermostat 73 to activate the air heater 71 for heating the air inside the housing to a temperature responsive to a temperature of the ambient environment. The air heater 71 is particularly suited from maintaining air surrounding the tanks 34, 37 of a temperature similar to that of the liquid contained therein to reduce heat transfer through walls of the unused liquid storage and heated liquid tanks due to a gradient in heat between fluids one of which is defined by the liquid and the other by the air that is inside the housing 12.

The heating assembly further includes a liquid dispensing device heater 75 arranged for applying heat to the liquid dispensing device 43 to in turn heat the liquid passing therethrough. In the illustrated arrangement, the liquid dispensing device heater 75 comprises a thermally conductive body 76 disposed in the interior 14 of the housing and attached to the faucet 43, which itself is thermally conductive, at or adjacent the supply end 47 to provide an interface for heat transmission, and a radiant heat source 78 configured for applying heat to the thermally conductive body 76 to be transmitted thereby to the faucet 43 via the heat transmission interface. The thermally conductive body 76 of the heating arrangement 75 is threadably mated on the connection portion 58 of the faucet so as to act as a fastener such as a nut for cooperating with the flange 56 to mount by clamping action to the intermediary wall 54.

As more clearly shown in FIG. 5, the thermally conductive body 76 comprises a generally cylindrical nut portion 80 defining a central circular cylindrical threaded bore 81 with a diameter which is an inner diameter substantially equal to an outer diameter of the connection portion 58 of the faucet so as to be configured for threadable mating thereon to clampingly engage the intermediary wall 54 and to provide the interface for heat transmission. The nut portion 80 is shorter in length which is oriented axially of the nut portion along an axis of the bore 81 than a length of the connection portion 58 of the faucet which is measured from the supply end 47 along an axis of the cylindrical connection portion to a location thereon where threading terminates in distal relation to the supply end 47, such that the connection portion 58 projects beyond an end 82 of the nut portion 80 to present the supply end 47 in spaced relation to the nut portion for receiving the liquid supply line 48.

Due to limits on the size of the nut portion 80, the thermally conductive body 76 comprises an extension portion 83 removably attached for example by threadable mating to the nut portion 80 in end-to-end relation therewith and defining a central bore 85 which is coaxially alignable with the nut bore 81 but having a diameter greater than the bore 81 of the nut portion to permit passage through the extension bore 85 of the liquid supply line 48 with enlarged coupling end 48A which is received externally over the supply end 47 of the faucet. The extension portion 83 is sized longer in length along an axis of its bore 85 than the coaxially arranged nut portion 80 so as to increase a total surface area of the thermally conductive body 76 available for contact with the radiant heat source 78 for receiving heat therefrom.

The radiant heat source 78 of the faucet heater 75 is in the form of an electric wire wrapped around the thermally conductive body 76 and configured to generate heat upon passage of electric current along the electric wire. The electric heating wire 78 is wrapped in a coil around the body 76 in direct contact therewith. The body 76 is made of a thermally conductive material such as stainless steel so as to act as a heat sink absorbing the heat applied thereto by the radiant heat wire 78 and to transmit the same by thermal conduction to the faucet via the heat transmission interface defined by the bore 81 of the nut portion which provides a thermally conductive surface for contacting a thermally conductive surface of the faucet 43. The faucet comprising a thermally conductive body which defines the passageway 50 thus conducts the transmitted heat to the liquid flowing therethrough. The windings of the coiled electric heating wire 78 are maintained in spaced relation by thermally insulating holders 88 received outwardly of the heating wire 78 and which act to clamp the wire 78 between the same and the body 76.

The liquid dispensing device heater 75 is provided in the form of a kit having a plurality of components for assembly in stages. Firstly the faucet 43 with the supply line 48 detached therefrom is mounted to the intermediary wall 54 by threadably mating the nut portion 80 on the connection portion 58 of the faucet arranged in a mounted position in which it is supported on the wall 54, as shown for example in FIG. 5, and passing through an opening in the wall 54 which acts as an exterior body for carrying the faucet. Next, the supply line 48 is attached to the supply end 47 of the faucet to establish fluidic communication therebetween. Subsequently, the extension portion 83 already received over the supply line 48 is connectable to the nut portion 80 carried by the faucet 43, so as to locate the supply end 47 and connected supply line 48 intermediate ends of the extension portion 83 one of which is substantially defined by the nut portion end 82 attached thereto and a free end 91 of the extension portion 83.

Further to the air heater 71 and the liquid dispensing device heater 75, the heating assembly includes a basin heater 94 arranged for applying heat to the basin 21 to in turn heat the liquid contained therein. Thus the unused liquid which is heated while in storage prior to dispensing and subsequently during dispensing through the faucet 43 is further heated while it is contained in the basin 21 which is exposed to the ambient environment during use of the station 10 to dispense liquid to a user.

In the illustrated arrangement, the basin heater 94 is in the form of an electric wire configured to generate heat upon passage of electric current along the electric wire. The electric heating wire 94 traverses a path across a surface of the basin 21 disposed in the housing interior 14, that is the electric heating wire 94 is disposed in contact with the basin 21 at an underside thereof which is exposed to the interior 14 of the housing. The electric heating wire 94 is arranged to follow a path across a surface of each of a bottom basin wall 21A locating the drain 59 and an upstanding rear wall 21B which is distal to the front end 12A of the housing, which have surfaces exposed to the housing interior 14 where the electric heating wire 94 can be placed. The wire 94 extends along a path formed across the surfaces of the basin walls spanning a majority and preferably substantially the whole of the surface areas of these surfaces. A plurality of holder strips 97 are affixed to the interior surfaces of the basin 21 to maintain the radiant heat wire 94 in direct contact therewith to transfer the heat generated by the wire to the basin.

The basin 21 is made from stainless steel so as to be suitably thermally conductive to spread or distribute heat from areas of the basin which are directly heated by the electric heating wire 94 to areas where heat is not directly applied.

The heating assembly yet further includes a drain conduit heater 99 for applying heat to the drain conduit 62. The drain conduit heater 99 is arranged to generate radiant heat and in the illustrated arrangement is in the form of an electric wire wrapped around the drain conduit and configured to generate heat upon passage of electric current along the electric wire. The electric heating wire 99 follows a helical path around the conduit 62 in direct contact therewith to heat the drain conduit 62 to in turn heat the liquid passing therethrough and to the waste liquid collection tank 61. The heating wire 99 is supported in contact with an outer surface of the drain conduit 62, which acts to transfer the heat from the wire 99 to the liquid flowing therethrough, for example by holders similar to those indicated at 88 in relation to the liquid dispensing device heater 75.

As such there is also provided a waste liquid collection tank heater 101 of the heating assembly that is arranged for applying heat to the waste liquid collection tank 61 to in turn heat the liquid contained therein. In the illustrated arrangement the waste liquid collection tank heater 101 is in the form of an electric wire configured to generate heat upon passage of electric current along the electric wire. The electric heating wire 101 traverses a path across a surface of the waste liquid collection tank that is external thereto, or in other words an outer surface of the tank 61, and is received in the underlying thermally insulating panel 63. More specifically, the electric heating wire 101 is arranged only at a bottom surface 103 of the tank 61 which is in close proximity to the underlying support surface beneath the housing 12. However the wire 101 extends along a path formed across the surface 103 of the tank 61 which spans a majority and preferably substantially the whole of the surface area of this surface. A remaining surface of the tank 61 is surrounded by air in the interior 14 of the housing, which is heated by the air heater 71. For example, the wire 101 is recessed into the insulating panel 63 by a plurality of grooves formed in its upper surface 63A which is in contact with the tank 61.

Thus the liquid which is dispensed is heated throughout the portable liquid dispensing station 10 at substantially all stages of conveyance from initial storage at the tanks 34, 37 where the liquid is substantially static, during dispensing via the dispensing device 43 while the liquid is flowing through the device 43, collection in the basin 21 and storage in the tank 61 as waste prior to removal from the housing 12.

As all of the radiant heat surfaces which generate heat to be transferred through solid mediums to in turn heat liquid are electrically powered, all of the electric heating wires are operatively electrically connected to a common electric power source (schematically shown) which is arranged to be connected to an external electrical source such as a conventional 110 V electrical power outlet. This same power source is operatively electrically connected to the pump 40 and to the air heater 71 which are also electrically powered. The station 10 may further include a visual warning indicator (not shown) carried externally on the housing 12 so as to be visible on the exterior thereof and which is configured to illuminate in response to detection of insufficient electrical power to power all of the electrically powered devices of the station 10.

Further to heating the liquid, the station 10 is configured to heat the soap contained in the dispenser 64 so that it remains in a sufficiently viscous liquid state suitable for dispensing to the user. This is achieved by mounting the soap dispenser 64 which contains the soap to be dispensed in an enclosed compartment 107 of the housing 12 arranged to receive the same, and which is distinct from the housing interior 14 where the unused liquid storage tank 34, the heated liquid tank 37 and the waste liquid collection tank 61 are contained. Despite being substantially distinct the soap dispenser compartment 107 is in communication with the housing interior 14 by a plurality of slot-like openings 109 defining a grill to receive heated air therefrom so as to act to heat the soap dispenser.

The compartment 107 is collectively formed by a receptacle 111, which is recessed into an exterior wall of the housing defined in the illustrated arrangement by the partial wall 25 and which acts to substantially fluidically separate the interior 14 of the housing from the interior of the compartment 107, and an openable door 112 which is carried for movement relative to the receptacle 111 between a closed position in which the compartment is enclosed to maintain the heated air around the soap dispenser 64 and an open position in which the compartment is open for accessing the soap dispenser. Thus the compartment 107 enables the heated air to heat the soap dispenser, the receptacle 111 of which is exposed to the housing interior 14 so as to be in the presence of the heated air provided by the air heater 71. The compartment 107 also acts to limit movement of the heated air out of the compartment to instances when the soap dispenser 64 needs to be accessed by the user and otherwise traps the air in the compartment surrounding the soap dispenser 64.

For portability of the liquid dispensing station 10, the base 13 of the housing 12 includes a plurality of forklift pockets 116 for mating support on a forklift for transport. The pockets 116 define openings at an exterior of the base 13 and elongated linear passageways extending inwardly from the openings at a periphery of the base.

Additionally, the station 10 includes a plurality of connection elements 118 supported on the top 27 of an exterior of the housing 12 and defining openings for receiving hooks of a crane for transport. The connection elements 118 are mounted to the structural framework 16 of the housing 12 in spaced relation to one another at corners of the top 27 of the full height portion 23. The connection elements 118 are in the form of cylindrical rods supported in spaced relation to a mounting structure to define a space for the crane hooks to grasp and surround the rods.

It will also be appreciated that in the illustrated arrangement the portable liquid dispensing station 10 includes a transparent divider wall 119 supported on the basin 21 by a channel-like member and having an top edge which follows an inner contour of the enclosure door 30 in the open position for providing a physical barrier to divide the common basin 21 into which a plurality of liquid dispensing devices 43 release the liquid, in order to prevent transmission of airborne contaminants between multiple users simultaneously using the station 10 as well as to deter physical touching. The illustrated arrangement of station 10 also includes a waste container 120 supported on the front 12A of the housing where for example used towels can be disposed.

In use, the liquid to be dispensed to a user, for example water which is susceptible to freezing, is heated at multiple stages in the dispensing process including during pre-dispensing storage such as in the heated liquid tank 37, at the thermally conductive liquid dispensing device 43 through which the liquid flows to be released to the user and which is exposed to the ambient environment during use, at the basin 21 where the liquid remains exposed to the ambient environment after release from the dispensing device 43 and which basin is also exposed to the ambient environment during use, upon storage post-dispensing in the waste liquid collection tank 61 prior to being transferred out of the housing 12 to waste, and furthermore upon transfer or conveyance from the basin 21 to the collection tank 61 immediately after the liquid has exited an interior volume of the basin 21 where the liquid is most prone to lose heat to the ambient environment.

Once the liquid is heated to a prescribed or desired temperature in the heated liquid tank 37, providing heating at multiple subsequent stages enables the station 10 to maintain the liquid at a substantially constant temperature at which the liquid will not freeze.

Radiant heat-type heating devices are all located inside the housing 12 so as to be shielded from the ambient environment and so that the waste heat generated thereby, which is not transferred to the intended target, may be absorbed the surrounding air in the interior 14 of the housing.

The interior 14 of the housing 12 is substantially open so that the air heater 71 can heat the surrounding air to aid in preventing the liquid from freezing particularly during storage either before or after dispensing.

This provides an arrangement which can operate in cold temperatures to continually dispense stored liquid that is susceptible to freezing in the cold temperatures.

As described hereinbefore, the present invention relates to a portable liquid dispensing station for outdoor use in cold temperatures which comprises a housing defining a base for resting on a support surface and enclosed interior thereover, at least one liquid storage tank supported inside the housing for containing unused liquid, a pump supported inside the housing in fluidic communication with the tank for conveying the unused liquid under pressure to a downstream location, a liquid dispensing device supported externally of the housing but in downstream fluidic communication with the tank for selectively releasing the liquid, a basin supported externally of the housing for collecting the released liquid, and a collection tank in fluidic communication with the basin to collect the used liquid for storage and which is supported inside the housing. The liquid dispensing device, the basin and the collection tank are heated and the air inside the housing is also heated to prevent the liquid from freezing.

The scope of the claims should not be limited by the preferred embodiments set forth in the examples but should be given the broadest interpretation consistent with the specification as a whole.

The invention claimed is:

1. A portable liquid dispensing station for outdoor use in cold temperatures comprising:

a housing defining a base arranged for resting on a support surface and a substantially enclosed interior over the base;

an unused liquid storage tank supported in the interior of the housing for containing unused liquid to be dispensed;

a heated liquid tank supported in the interior of the housing and disposed in fluidic communication with the unused liquid storage tank for receiving the unused liquid therefrom, the heated liquid tank being configured for heating and containing the unused liquid for subsequent dispensing;

a pump supported in the interior of the housing and disposed in operative fluidic communication with the unused liquid storage tank and the heated liquid tank to convey the unused liquid therefrom under pressure to a location which is downstream relative to a flow of the unused liquid;

a liquid dispensing device supported externally of the housing and disposed in fluidic communication with the unused liquid storage tank and the heated liquid tank downstream of the pump for receiving the unused liquid under pressure, the liquid dispensing device being configured for selectively releasing the liquid externally of the housing;

a basin supported externally of the housing and arranged for collecting the liquid released from the liquid dispensing device;

a waste liquid collection tank disposed in fluidic communication with the basin and supported in the interior of the housing for receiving and containing used liquid for subsequent removal from the housing; and a heating assembly comprising:

an air heater supported in the interior of the housing and arranged for heating air contained in the interior of the housing to heat the unused liquid storage tank and the heated liquid tank;

a waste liquid collection tank heater arranged for applying heat to the waste liquid collection tank to in turn heat the liquid contained therein; and a basin heater arranged for applying heat to the basin to in turn heat the liquid contained therein.

2. The portable liquid dispensing station of claim 1 wherein the heating assembly further includes a liquid dispensing device heater arranged for applying heat to the liquid dispensing device to in turn heat the liquid passing therethrough.

3. The portable liquid dispensing station of claim 2 wherein the liquid dispensing device comprises a thermally conductive faucet defining a discharge end disposed externally of the housing and arranged for releasing the liquid into the basin and a supply end disposed in the interior of the housing and arranged for fluidic coupling to a liquid supply line arranged to convey the liquid thereto, and wherein the liquid dispensing device heater comprises (i) a thermally conductive body disposed in the interior of the housing and attached to the faucet at or adjacent the supply end to provide an interface for heat transmission, and (ii) a radiant heat source configured for applying heat to the thermally conductive body to be transmitted thereby to the faucet via said interface for heat transmission.

4. The portable liquid dispensing station of claim 3 wherein the faucet includes a flange coupled thereto externally of the housing and disposed in spaced relation to the thermally conductive body, and wherein the thermally conductive body is threadably mated on an externally threaded connection portion of the faucet defining the supply end, so as to act as a fastener for cooperating with the flange to mount the faucet by clamping action to an intermediary wall between the thermally conductive body and the flange.

5. The portable liquid dispensing station of claim 4 wherein the thermally conductive body comprises:

a nut portion defining a threaded bore with a diameter substantially equal to an outer diameter of the threaded connection portion of the faucet so as to be configured for threadable mating thereon to clampingly engage the intermediary wall and to provide the interface for heat transmission, wherein the nut portion is shorter in length than the connection portion of the faucet such that the connection portion projects beyond the nut portion to present the supply end in spaced relation to the nut portion; and an extension portion removably attached to the nut portion and defining a bore with a diameter greater than the bore of the nut portion to permit passage therethrough of the liquid supply line fluidicallly coupled to the supply end of the faucet, wherein the extension portion is sized longer in length than the nut portion so as to increase a surface area of the thermally conductive body for receiving heat from the radiant heat source.

6. The portable liquid dispensing station of claim 3 wherein the radiant heat source is in the form of an electric wire wrapped around the thermally conductive body and configured to generate heat upon passage of electric current along the electric wire.

7. The portable liquid dispensing station of claim 1 wherein the basin and the waste liquid collection tank are fluidically intercommunicated by a drain conduit, and wherein the heating assembly further includes a drain conduit heater for applying heat to the drain conduit.

8. The portable liquid dispensing station of claim 7 wherein the drain conduit heater is in the form of an electric wire wrapped around the drain conduit and configured to generate heat upon passage of electric current along the electric wire.

9. The portable liquid dispensing station of claim 1 wherein the air heater is operatively associated with a thermostat configured to actuate the air heater and supported externally of the housing so as to be exposed to an ambient environment.

10. The portable liquid dispensing station of claim 1 further including a soap dispenser configured to contain and selectively release soap and carried by the housing at an exterior accessible location thereon, and wherein the housing forms an enclosed compartment distinct from the interior of the housing and arranged for receiving the soap dispenser, the enclosed compartment comprising a plurality of openings by which the enclosed compartment is in communication with the interior of the housing to receive heated air therefrom so as to act to heat the soap dispenser.

11. The portable liquid dispensing station of claim 10 wherein the enclosed compartment is formed by a receptacle recessed into an exterior wall of the housing and an openable door which is carried for movement relative to the receptacle between a closed position in which the compartment is enclosed to maintain the heated air around the soap dispenser and an open position in which the compartment is open for accessing the soap dispenser.

12. The portable liquid dispensing station of claim 1 wherein the basin is made from stainless steel.

13. The portable liquid dispensing station of claim 1 wherein the basin heater is in the form of an electric wire configured to generate heat upon passage of electric current along the electric wire, wherein the electric wire traverses a path across a surface of the basin disposed in the interior of the housing.

14. The portable liquid dispensing station of claim 1 wherein the waste liquid collection tank heater is in the form of an electric wire configured to generate heat upon passage of electric current along the electric wire, wherein the electric wire traverses a path across a surface of the waste liquid collection tank external thereto and is received in an underlying thermally insulating panel supporting the waste liquid collection tank above the base of the housing.

15. The portable liquid dispensing station of claim 1 wherein the air heater is a convection heater.

16. The portable liquid dispensing station of claim 1 wherein the base comprises a plurality of forklift pockets for mating support on a forklift for transport.

17. The portable liquid dispensing station of claim 1 further including a plurality of connection elements supported on a top of an exterior of the housing and defining openings for receiving hooks of a crane for transport.

18. A portable liquid dispensing station for outdoor use in cold temperatures comprising:

a housing defining a base arranged for resting on a support surface and a substantially enclosed interior over the base;

an unused liquid storage tank supported in the interior of the housing for containing unused liquid to be dispensed;

a heated liquid tank supported in the interior of the housing and disposed in fluidic communication with the unused liquid storage tank for receiving the unused liquid therefrom, the heated liquid tank being configured for heating and containing the unused liquid for subsequent dispensing;

a pump supported in the interior of the housing and disposed in operative fluidic communication with the unused liquid storage tank and the heated liquid tank to convey the unused liquid therefrom under pressure to a location which is downstream relative to a flow of the unused liquid;

a liquid dispensing device supported externally of the housing and disposed in fluidic communication with the unused liquid storage tank and the heated liquid tank downstream of the pump for receiving the unused liquid under pressure, the liquid dispensing device being configured for selectively releasing the liquid externally of the housing;

a basin supported externally of the housing and arranged for collecting the liquid released from the liquid dispensing device;

a waste liquid collection tank disposed in fluidic communication with the basin and supported in the interior of the housing for receiving and containing used liquid for subsequent removal from the housing;

a heating assembly comprising:

an air heater supported in the interior of the housing and arranged for heating air contained in the interior of the housing to heat the unused liquid storage tank and the heated liquid tank;

a waste liquid collection tank heater arranged for applying heat to the waste liquid collection tank to in turn heat the liquid contained therein;

a soap dispenser configured to contain and selectively release soap and carried by the housing at an exterior accessible location thereon; and wherein the housing forms an enclosed compartment distinct from the interior of the housing for receiving the soap dispenser, the enclosed compartment comprising a plurality of openings by which the enclosed compartment is in communication with the interior of the housing to receive heated air therefrom so as to act to heat the soap dispenser.

* * * * *